US010913582B2

(12) United States Patent
Sterling et al.

(10) Patent No.: US 10,913,582 B2
(45) Date of Patent: Feb. 9, 2021

(54) TAP DISPENSER LOCK DEVICE FOR CONTAINER

(71) Applicant: Henkel IP & Holding GmbH, Duesseldorf (DE)

(72) Inventors: Daniel Peter Sterling, Fairfield, CT (US); Samuel Edward Nuckels, Florence, AL (US); Keith J. Colacioppo, Harrison, NY (US)

(73) Assignee: Henkel IP & Holding GmbH

( * ) Notice: Subject to any disclaimer, the term of this patent is extended or adjusted under 35 U.S.C. 154(b) by 0 days.

(21) Appl. No.: 16/455,382

(22) Filed: Jun. 27, 2019

(65) Prior Publication Data

US 2020/0407129 A1 Dec. 31, 2020

(51) Int. Cl.

| | |
|---|---|
| ***B65D 47/06*** | (2006.01) |
| ***B65D 47/20*** | (2006.01) |
| *B67D 1/14* | (2006.01) |

(52) U.S. Cl.

CPC ..... *B65D 47/2081* (2013.01); *B65D 47/06* (2013.01); *B67D 1/1405* (2013.01)

(58) Field of Classification Search

CPC .... B65D 47/2081; B65D 47/06; B65D 47/24; B65D 47/12; B65D 47/40; B65D 55/02; B65D 55/04; B65D 55/08; B65D 55/063; B65D 55/0863; B67D 1/2405

USPC ..... 222/153.13–153.14, 544, 509, 559, 222/511–518

See application file for complete search history.

(56) References Cited

U.S. PATENT DOCUMENTS

| | | | | |
|---|---|---|---|---|
| 4,848,600 A * | 7/1989 | Dark | B65D 47/20 222/498 |
| 6,131,767 A * | 10/2000 | Savage | B67D 3/043 222/1 |
| 8,893,924 B2 * | 11/2014 | Cash | B65D 23/10 206/509 |
| 2004/0238569 A1 * | 12/2004 | Robinson | B67D 1/08 222/153.14 |
| 2020/0102124 A1 * | 4/2020 | Driskell | B65D 41/04 |

OTHER PUBLICATIONS

ULINE Electrical Tape—3/4"×20 yds, White, retrieved on Jun. 13, 2019 from https://www.uline.com/Product/Detail/S-7858/Electrical-Tape/Electrical-Tape-3-4-x-20-yds-Whitepricode=WB0220&gadtype=pla&id=S-7858&gclid=Cj0KCQjw6lfoBRCiARIsAF6q06t8rp4rthwnhQEAHtpNDiZ4xaMXoEUBYK_4z-HLoT8z1_UboWbHEHAaAv_wEALw_wcB&gclsrc=aw.ds.

* cited by examiner

*Primary Examiner* — Paul R Durand
*Assistant Examiner* — Andrew P Bainbridge
(74) *Attorney, Agent, or Firm* — Bojuan Deng

(57) ABSTRACT

A tap lock has an engagement member, a barrier member, and a retainer member that extends between the engagement member and the barrier member and that retains the engagement member at a fixed position relative to the barrier member. The engagement member removably attaches to a support structure of a tap dispensing closure of a container body. The barrier member is disposed proximate an outlet passage and valve member of the tap dispensing closure. The barrier member limits movement of the valve member from a closed position toward an open position to prevent leakage of material from the outlet passage.

20 Claims, 4 Drawing Sheets

TAP DISPENSER LOCK DEVICE FOR CONTAINER

FIELD OF THE INVENTION

The following relates to a container and, more particularly, to a tap dispenser lock device for a container.

BACKGROUND OF THE INVENTION

Some containers include dispensing closures, which are used to selectively dispense material contained therein. For example, containers sometimes include a tap that a user may manually actuate to dispense a liquid product (e.g., a liquid detergent, beverage, or other substance) from the container.

Taps should be robust enough to avoid leakage of the product from the container. However, some taps may not adequately seal the product within the container under some loads. Furthermore, many taps are included on large volume containers. Thus, the fluid pressure on the tap may be high, thereby increasing the possibility of leakage. Shipping these types of containers while filled with product may be difficult, for example, given the limitations of the taps that are included on those containers.

Therefore, there exists a need for a device for improving the seal integrity of a tap dispenser for a container. There is also a need for a device that is convenient to use. Moreover, there is a need for an improved dispenser lock device that is highly manufacturable. Other desirable features and characteristics of the systems and methods of the present disclosure will become apparent from the subsequent detailed description and the appended claims, taken in conjunction with the accompanying drawings and the preceding background.

BRIEF SUMMARY OF THE INVENTION

Embodiments of a tap dispenser lock device are provided. In various embodiments, the tap dispenser lock device includes a tap dispensing closure configured for selective dispensing of a material from a container body. The tap dispensing closure includes a support structure with an outlet passage configured to dispense the material. The tap dispensing closure also includes a valve member that is supported for movement along an axis relative to the support structure between an open position and a closed position. The outlet passage is open for dispensing of the material when the valve member is in the open position. The outlet passage is closed by the valve member when the valve member is in the closed position. The tap dispensing closure includes an actuator for selectively actuating the valve member from the closed position to the open position. The tap dispenser lock device also includes a tap lock having an engagement member, a barrier member, and a retainer member that extends between the engagement member and the barrier member and that retains the engagement member at a fixed position relative to the barrier member. The engagement member removably attaches to the support structure with the barrier member disposed proximate the outlet passage and the valve member. The barrier member limits movement of the valve member in a direction along the axis away from the closed position toward the open position to prevent leakage of the material from the outlet passage.

Embodiments of a container assembly are further provided. The container assembly includes a container body configured to contain a liquid material. The container assembly also includes a tap dispensing closure attached to the container body and configured for selective dispensing of the material therefrom. The tap dispensing closure includes a support structure with an outlet passage configured to dispense the material. The tap dispensing closure includes a valve member that is supported for movement along an axis relative to the support structure between an open position and a closed position. The outlet passage is open for dispensing of the material when the valve member is in the open position. The outlet passage is closed by the valve member when the valve member is in the closed position. The tap dispensing closure includes an actuator for selectively actuating the valve member from the closed position to the open position. The container assembly further includes a tap lock including an engagement member, a barrier member, and a retainer member that extends between the engagement member and the barrier member and that retains the engagement member at a fixed position relative to the barrier member. The engagement member removably attaches to the support structure with the barrier member disposed proximate the outlet passage and the valve member. The barrier member limits movement of the valve member in a direction along the axis away from the closed position toward the open position to prevent leakage of the material from the outlet passage.

Methods for manufacturing a tap dispenser lock device are still further provided. In some embodiments, the method includes providing a tap dispensing closure configured for selective dispensing of a material from a container body. The tap dispensing closure includes a support structure with an outlet passage configured to dispense the material. The tap dispensing closure includes a valve member that is supported for movement along an axis relative to the support structure between an open position and a closed position. The outlet passage is open for dispensing of the material when the valve member is in the open position. The outlet passage is closed by the valve member when the valve member is in the closed position. The tap dispensing closure includes an actuator for selectively actuating the valve member from the closed position to the open position. The method also includes providing a tap lock that includes an engagement member, a barrier member, and a retainer member that extends between the engagement member and the barrier member and that retains the engagement member at a fixed position relative to the barrier member. Also, the method includes removably attaching the engagement member to the support structure with the barrier member disposed proximate the outlet passage and the valve member. The barrier member limits movement of the valve member in a direction along the axis away from the closed position toward the open position to prevent leakage of the material from the outlet passage.

The foregoing statements are provided by way of non-limiting example only. Various additional examples, aspects, and other features of embodiments of the present disclosure are encompassed by the present disclosure and described in more detail below.

BRIEF DESCRIPTION OF THE DRAWINGS

At least one example of the present disclosure will hereinafter be described in conjunction with the following figures, wherein like numerals denote like elements, and.

For simplicity and clarity of illustration, descriptions and details of well-known features and techniques may be omitted to avoid unnecessarily obscuring the exemplary and non-limiting embodiments of the present disclosure described in the subsequent Detailed Description. It should further be understood that features or elements appearing in the accompanying figures are not necessarily drawn to scale unless otherwise stated.

DETAILED DESCRIPTION OF THE INVENTION

The following Detailed Description is merely exemplary in nature and is not intended to limit the present disclosure or the application and uses of the same. The term "exemplary," as appearing throughout this document, is synonymous with the term "example" and is utilized repeatedly below to emphasize that the following description provides only multiple non-limiting examples of the present disclosure and should not be construed to restrict the scope of the present disclosure, as set-out in the Claims, in any respect.

Tap dispenser lock devices are provided, as are methods for manufacturing such devices. Generally, the tap dispenser lock devices described herein may include a tap lock that may be removably attached to a tap dispensing closure. When attached, the tap lock secures a tap dispensing closure in a closed position. Thus, the tap lock helps prevent leakage of material from the tap of the container. Also, the tap lock may be conveniently and easily removed to allow material to be selectively dispensed from the tap dispensing closure.

As will be discussed, the tap lock may include an engagement member that removably attaches to a support structure of the tap dispensing closure. The tap lock may also include a barrier member that limits movement of a valve member of the tap dispensing closure. Furthermore, the tap lock may include a retainer member that extends between the engagement member and the barrier member. The retainer member may retain the engagement member at a fixed position relative to the barrier member. The engagement member, the barrier member, and the retainer member may comprise a plurality of walls. As such, the tap lock may be a relatively thin-walled, unitary, one-piece component and, yet, the tap lock may be constructed with sufficient strength and rigidity to hold the tap in the closed position. The tap lock may also be very compact. The tap lock may be highly manufacturable and may be convenient to attach and remove from the tap dispensing closure. Accordingly, the tap lock provides a number of features and advantages, which will be described in greater detail below with respect to example embodiments.

Figure 1:
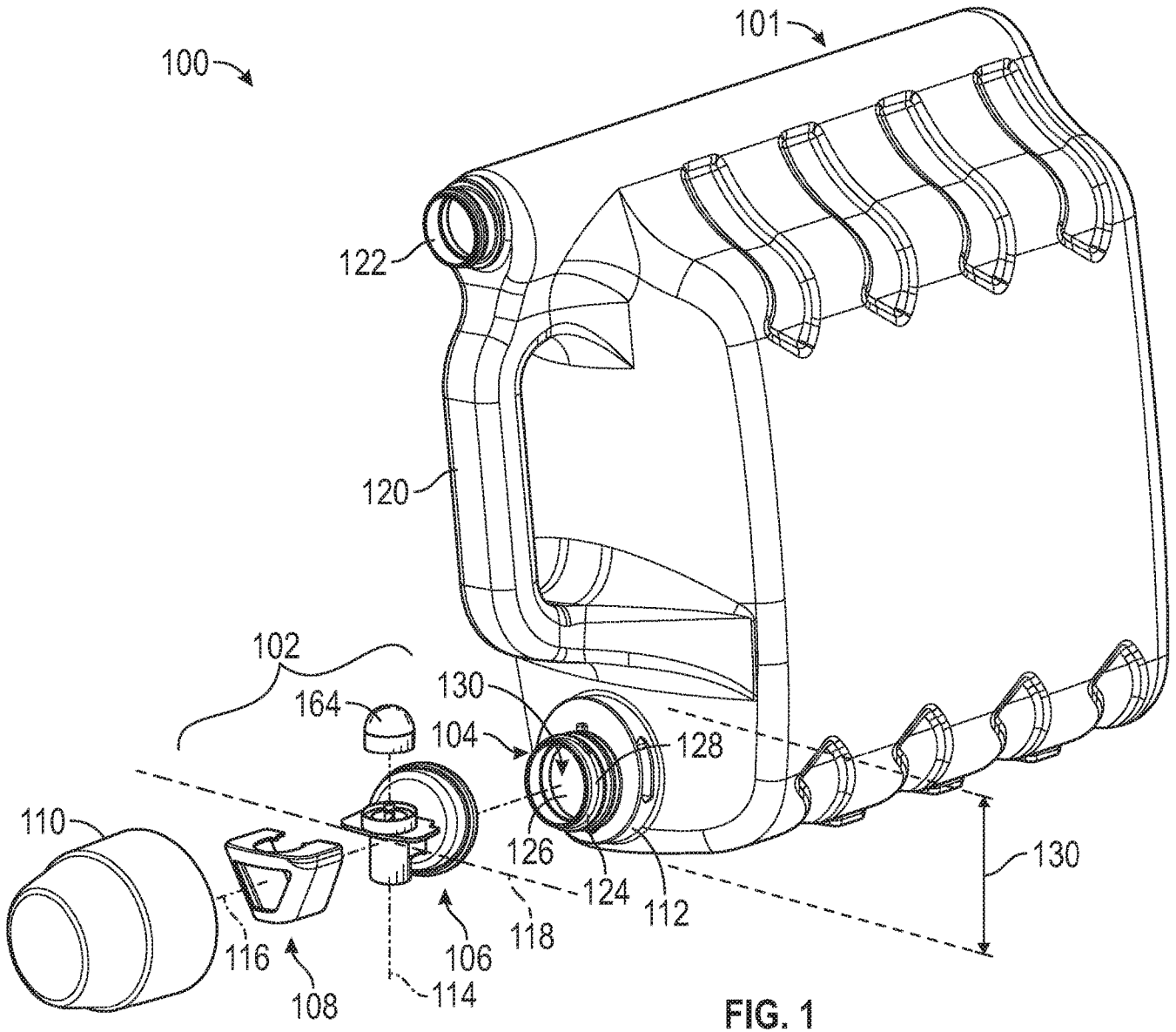
FIG. 1 is a perspective exploded view of a container assembly that includes a container closure device according to example embodiments of the present disclosure.

FIG. 1 illustrates a container assembly 100 according to example embodiments. The container assembly 100 may include a container body 101 and a tap dispenser lock device 102. The tap dispenser lock device 102 may include a tap dispensing closure 106 that is configured for selectively dispensing a liquid material (e.g., detergent, beverage, etc.) from the container body 101. The tap dispensing closure 106 may include features of a known tap closure configured for selectively dispensing a product from within the container body 101. The illustrated tap dispensing closure 106 is merely exemplary and may vary without departing from the scope of the present disclosure. As will be discussed, the tap dispensing closure 106 may include a tap-type valve that moves between a closed position and an open position. In the closed position, the tap dispensing closure 106 seals the liquid within the container body 101 and prevents leakage. In the open position, the tap dispensing closure 106 dispenses the liquid.

The tap dispenser lock device 102 may also include a tap lock 108. The tap lock 108 may removably attach to the tap dispensing closure 106. As will be described, the tap lock 108 may be attached to thereby retain and secure the tap dispensing closure 106 in the closed position. Accordingly, liquid material within the container body 101 is unlikely to inadvertently spill or leak through the tap dispensing closure 106. The tap lock 108 may be useful, for example, when shipping the container assembly 100 filled with liquid product. Then, when a user wishes to dispense the product, the user can easily and conveniently remove the tap lock 108 from the tap dispensing closure 106. Thus, the tap lock 108 is a secure, convenient, and useful feature that prevents leakage of the product.

The container assembly 100 of FIG. 1 will now be discussed in greater detail according to example embodiments. A Cartesian coordinate system is included for reference purposes and includes a first axis 114 (a dispensing axis), a second axis 116 (a longitudinal axis), and a third axis 118 (a lateral axis).

As shown in FIG. 1, the container body 101 may be a tub-like vessel or bottle that is configured for holding a liquid. In some embodiments, the container body 101 may be a molded (injection molded), plastic, and unitary article. The container body 101 may have a volume of at least sixty-four ounces (64 oz.) in some embodiments. The container body 101 may include a handle 120. The container body 101 may also include a vent opening 122. Although not shown, a cap (e.g., a threaded screw cap) may be attached to the vent opening 122. Furthermore, the container body 101 may include an outlet structure 104. The outlet structure 104 may include a cylindrical projection that defines a seat 112 on an outer radial surface thereof. The outlet structure 104 may also include a neck 124 that extends along the axis 116. The neck 124 may be annular and may define a throat or outlet opening 126 that provides a fluid outlet for the liquid within the container body 101. The outlet opening 126 may be substantially circular in some embodiments and may be substantially centered about the axis 116. Additionally, the neck 124 may include a coupling member 128 for removable attachment of the tap dispensing closure 106. In some embodiments, the coupling member 128 may be a threading that is included on an outer diameter surface of the neck 124.

Moreover, the container assembly 100 may further include a cup 110 that removably attaches to the seat 112 of the container body 101. The cup 110 may have a rim that corresponds to the seat 112 such that the cup 110 removably fits (e.g., frictionally attaches) to the seat 112. The tap dispenser lock device 102 may fit within the cup 110 when attached at the seat 112. Stated differently, the seat 112 may have a width dimension 130 (e.g., a diameter) measured normal to the axis 116, and the tap lock 108 and the tap dispensing closure 106 may be smaller than and may fit within the width dimension 130. As such, the tap dispenser lock device 102 may be very compact. The tap lock 108, in particular, may be compact and may be incorporated inside the cup 110. Thus, the tap lock 108 may be incorporated within existing container assemblies 100 having a cup 110, tap dispensing closure 106, and outlet structure 104 without having to reconfigure the same.

Figure 2:
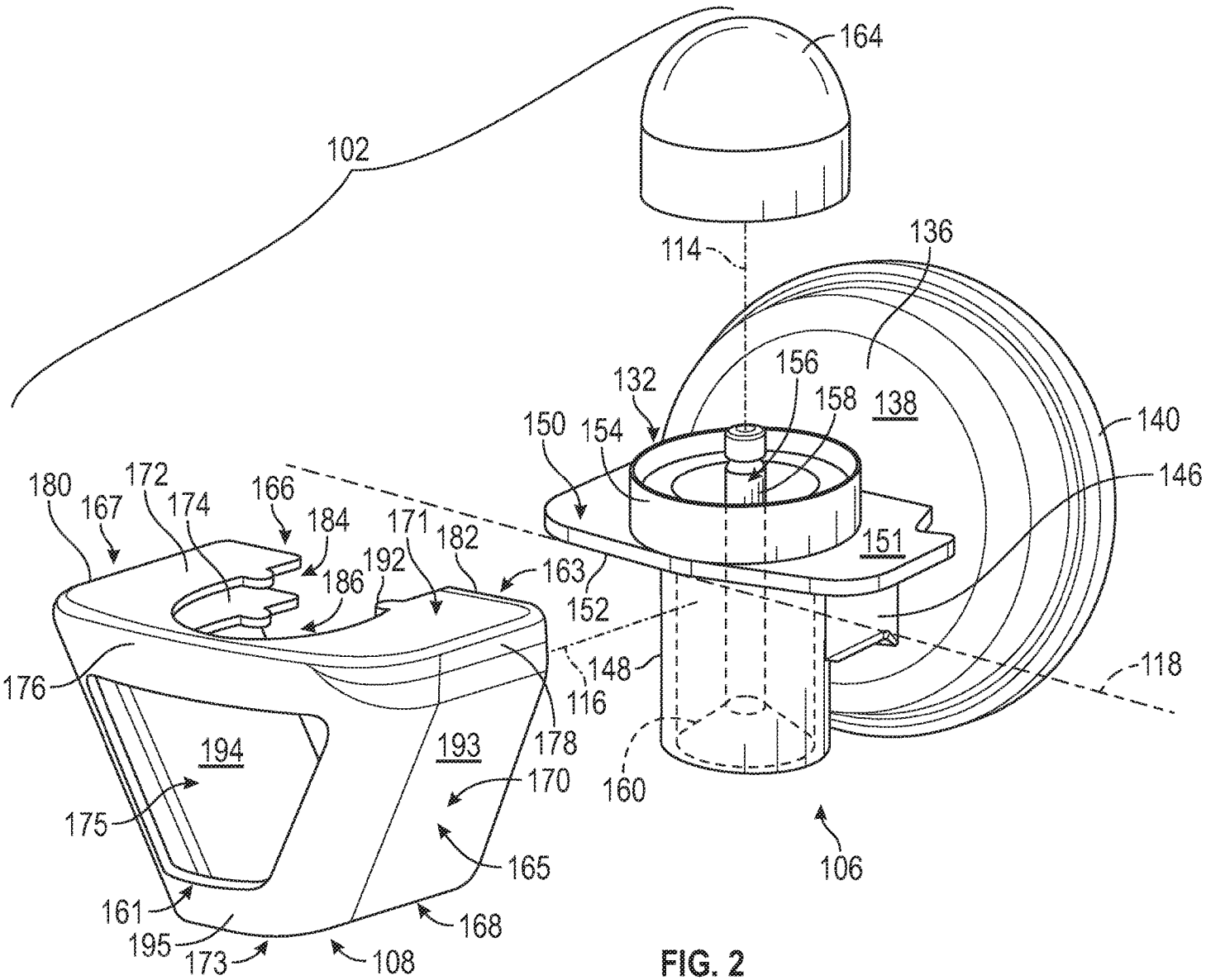
FIG. 2 is a perspective exploded view of the container closure device of FIG. 1.

Referring now to FIG. 2, the tap dispensing closure 106 of the tap dispenser lock device 102 will be discussed in greater detail. The tap dispensing closure 106 may include a support structure 132. The support structure 132 may be a rigid member constructed from hard and strong material, such as a hard plastic. The support structure 132 may be formed from a molding process, such as injection molding in some embodiments. In other embodiments, the support structure 132 may be formed using an additive manufacturing process (e.g., 3-D printing, etc.) or other rapid manufacturing technique.

Figure 3:
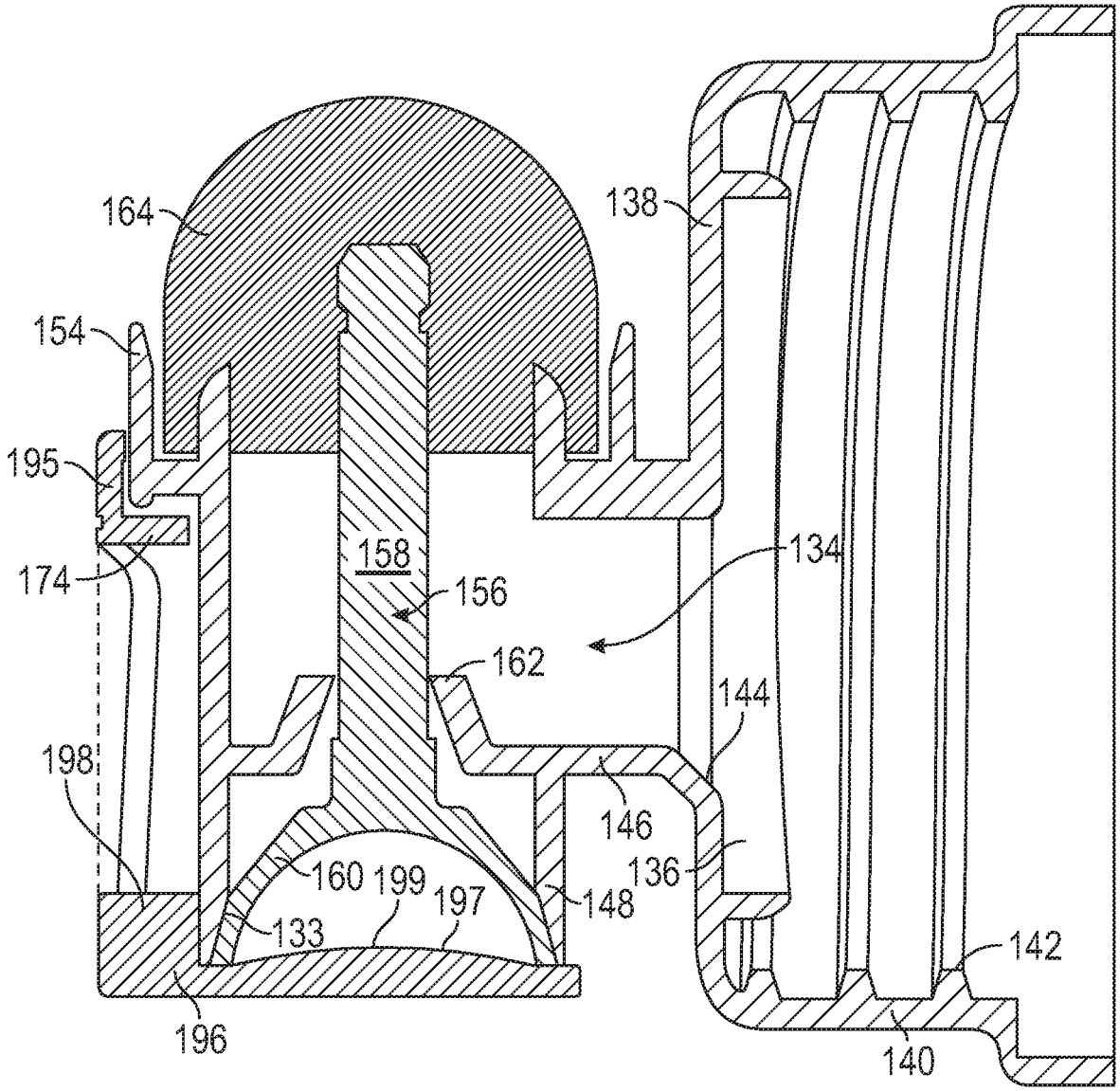
FIG. 3 is a sectioned assembly view of the container closure device of FIG. 1.

The support structure 132 may include a cap 136. The cap 136 may include a cover member 138, which may be a substantially circular and flat disc. The cover member 138 may be substantially planar and may be disposed normal to the axis 116. The cap 136 may also include a coupling portion 140. As shown in FIG. 3, the coupling portion 140 may include a coupling member 142 for removable attachment of the tap dispensing closure 106 to the container body 101. In some embodiments, the coupling member 142 may be a threading that included on an inner diameter of the cap 136 and that threadably engages the coupling member 128 of the container body 101. When the coupling member 142 is attached to the container body 101, the cover member 138 may substantially cover over the outlet opening 126 of the container body 101. Thus, the tap dispensing closure 106 may be removably attached to the container body 101 in some embodiments; however, in other embodiments, the tap dispensing closure 106 may be integrally connected to the container body 101 so as to be unitary therewith.

As shown in FIG. 3, the support structure 132 may further include an intermediate portion 146 and a spout 148. The intermediate portion 146 may be a hollow structure that projects from the cap 136 and that extends substantially along the axis 116. The spout 148 may be cylindrical, barrel-shaped, and hollow. The spout 148 may be attached to the intermediate portion 146 and may depend therefrom along the axis 114.

An outlet passage 134 may extend through the support structure 132, from an aperture 144 in the cap 136, through the intermediate portion 146 along the axis 116, and through the spout 148 along the axis 114. The outlet passage 134 of the support structure 132 may terminate at a spout opening 133 (FIG. 3). The outlet passage 134 is configured to dispense material from the container body 101, directing flow of material from the outlet opening 126 and out of the container body 101.

Additionally, the support structure 132 may include a flange 150. The flange 150 may be flat and thin-walled and may extend laterally from both sides of the axis 114 and generally along the axis 118. Accordingly, the flange 150 may include a top side 151 and an underside 152. The underside 152 faces opposite the top side 151. The spout 148 may project from the underside 152 of the flange 150. As shown in FIG. 2, the flange 150 may extend along the axis 118 from both sides of the spout 148.

Furthermore, the support structure 132 may include an actuator base 154. The actuator base 154 may be an annular member that projects from the top side 151 of the flange 150. The actuator base 154 may be substantially centered on the flange 150.

Also, the tap dispensing closure 106 may include a valve member 156. The valve member 156 may include a post 158 and an enlarged head 160. The head 160 may be dome-shaped in some embodiments, and the post 158 may be project from an apex of the head 160. The valve member 156 may be received within the outlet passage 134 with the post 158 supported for movement by a valve support 162 (FIG. 3). Furthermore, the head 160 may be disposed proximate the spout opening 133. Additionally, the opposite end of the valve member 156 may project upward into the actuator base 154.

The valve member 156 may be supported for movement relative to the support structure 132. In some embodiments, the valve member 156 may be supported for linear movement along (parallel to) the axis 114 between a closed position and an open position. The valve member 156 is shown in the closed position in FIG. 3. As shown, the head 160 may seal against the inner surface of the spout opening 133 and close off the spout opening 133 such that liquid material is prevented from flowing out. In contrast, the valve member 156 may move linearly downward along the axis 114 when moving from the closed position to the open position to unseal the head 160 and open the spout opening 133 for dispensing of the material. In some embodiments, the valve member 156 may be biased by a biasing member toward the closed position. The biasing member may include a spring in some embodiments.

The tap dispensing closure 106 may further include an actuator 164. As shown in FIGS. 1-3, the actuator 164 may be a flexible pushbutton that is dome-shaped and that is attached and supported by the actuator base 154; however, the actuator 164 may be a lever, a slider, or other mechanism that can be manually actuated for selectively actuating the valve member 156 from the closed position toward the open position. Specifically, a user's hand may place a thumb on the actuator 164 and other fingers on the underside 152 of the flange 150 projecting laterally from both sides of the actuator 164. Then, the user may push the actuator 164 along the axis 114 toward the flange 150, thereby pushing the valve member 156 downward along the axis 114 and opening the spout opening 133. Release of the actuator 164 allows the valve member 156 to bias back toward the closed position.

Figure 4:
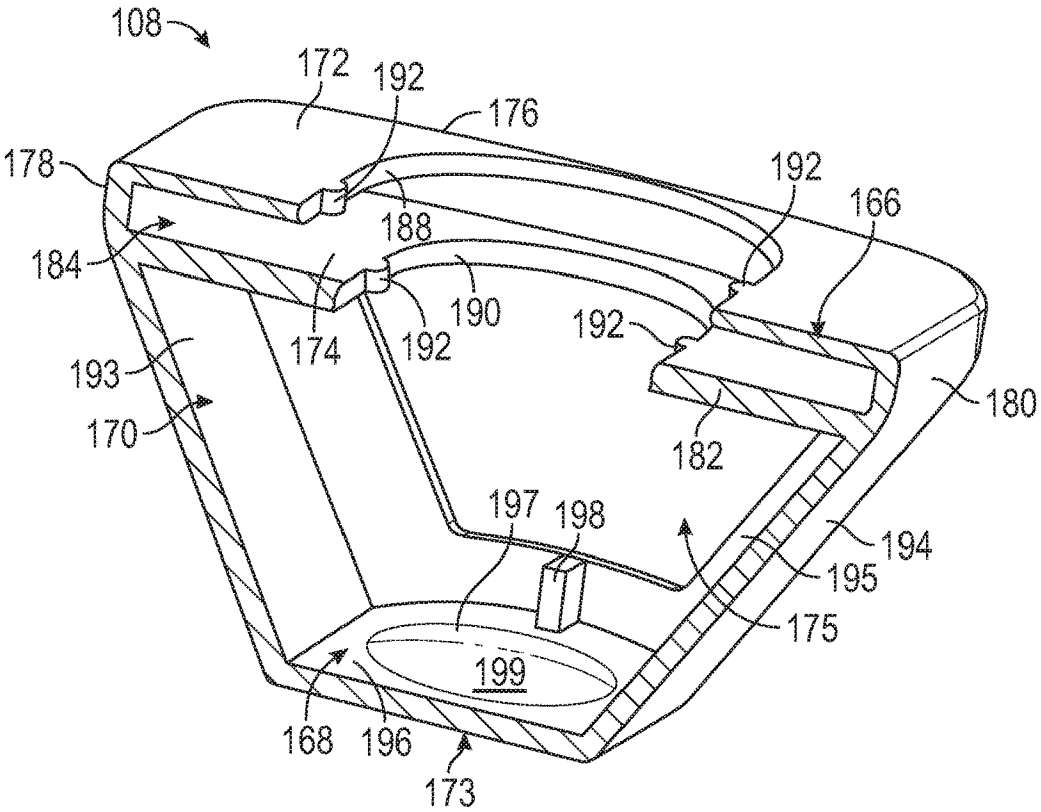
FIG. 4 is a perspective view of a tap lock of the container closure device, taken from an opposite perspective from FIGS. 1 and 2.

Referring now to FIGS. 2-4, the tap lock 108 will be discussed in greater detail according to example embodiments. In some embodiments, the tap lock 108 may be a unitary, one-piece member that made of relatively hard and strong material, such as hard plastic. The tap lock 108 may be formed from a molding process, such as injection molding in some embodiments. In other embodiments, the tap lock 108 may be formed using an additive manufacturing method (e.g., 3-D printing) or another rapid manufacturing technique. Furthermore, the tap lock 108 may be a relatively thin-walled member and may include a plurality of interconnected walls, panels, braces, etc. that are arranged to receive and releasably engage the tap dispensing closure 106.

Generally, the tap lock 108 may include a front side 161, a back side 163, a first lateral side 165, a second lateral side 167, a top end 171 and a bottom end 173. The back side 163 may be open to accommodate and receive the tap dispensing closure 106. The front side 161 may also include a window opening 175. In contrast, the first lateral side 165, the second lateral side 167, the top end 171 and the bottom end 173 may be substantially continuous so as to cover over the tap dispensing closure 106 when the tap lock 108 is attached thereto.

The tap lock 108 may be substantially rigid and inflexible in some embodiments. The tap lock 108 may also be self-supporting and may remain rigid under relatively high loading. In some embodiments, one or more portions of the tap lock 108 may exhibit a slight degree of resilient flexibility, for example, so that the tap lock 108 may be snap-fit to the support structure 132 of the tap dispensing closure 106. However, the tap lock 108 may exhibit enough rigidity and strength for securely engaging the tap dispensing closure 106 and maintaining the valve member 156 in the closed position when subjected to normal loading (e.g., dynamic loads of the fluid on the valve member 156 during shipping, etc.). Accordingly, as will be described, the tap lock 108 may function as a clamp, clip, brace, or other retainer for the tap dispensing closure 106.

Generally, the tap lock 108 may include an engagement member 166, a barrier member 168, and a retainer member 170. The engagement member 166 and the barrier member 168 may be spaced apart along the first axis 114, and the retainer member 170 may extend therebetween. The retainer member 170 may retain the engagement member 166 and the barrier member 168 separated at a fixed distance with respect to the first axis 114. Also, the retainer member 170 may resist twisting or torque of the engagement member 166 about the first axis 114 relative to the barrier member 168. It will be appreciated that the retainer member 170 may allow for slight resilient flexure that are within predetermined tolerances, that allow for snap-fit attachment to the tap dispensing closure 106, etc. However, the retainer member 170 and the other portions of the tap lock 108 may be substantially rigid.

The engagement member 166 may be disposed proximate and/or may substantially define the top end 171 of the tap lock 108. In some embodiments, the engagement member 166 may be generally box-shaped and may include a plurality of walls including a first engagement wall 172 and a second engagement wall 174. The first engagement wall 172 may define the top end 171 of the tap lock 108. The first and second engagement walls 172, 174 may be planar and may be substantially parallel to the plane defined by the second axis 116 and the third axis 118 (i.e., normal to the first axis 114). The periphery of the first and second engagement walls 172, 174 may be fixed to the retainer member 170 to define a front side 176, a first lateral side 178, a second lateral side 180, and a back side 182 of the engagement member 166. Accordingly, the first and second engagement walls 172, 174, the first lateral side 178, and the second lateral side 180 of the engagement member 166 may collectively define a pocket 184 that is open and accessible at the back side 182. As will be discussed, the pocket 184 may be configured for receiving and engaging with the support structure 132 of the tap dispensing closure 106.

The back side 182 of the engagement member 166 may include a cutout aperture 186 (FIG. 2). Specifically, the first engagement wall 172 may include a first notch, groove, or another aperture that is defined by a first U-shaped rim 188. Likewise, the second engagement wall 174 may include a second notch, groove, or another aperture that is defined by a second U-shaped rim 190. The first rim 188 and the second rim 190 may be substantially aligned along the first axis 114.

In some embodiments, at least one (e.g., both) of the first and second rims 188, 190 may include one or more snap-fit retainers 192. As shown in FIGS. 2 and 3, the snap-fit retainers 192 may include rounded projections that project radially inward from the respective rim 188, 190. In some embodiments, each of the first and second rims 188, 190 may include two opposing snap-fit retainers 192. Also, the rims 188, 190 may be U-shaped with the ends thereof extending substantially parallel to the second axis 116, and the snap-fit retainers 192 may project from these areas of the rims 188, 190. As will be discussed, the snap-fit retainers 192 may provide convenience when attaching the tap lock and/or when detaching the tap lock 108 from the support structure 132 of the tap dispensing closure 106.

The retainer member 170 of the tap lock 108 may include a plurality of walls, including a first lateral wall 193 that defines the first lateral side 165 of the tap lock 108, a second lateral wall 194 that defines the second lateral side 167, and a front wall 195 that defines the front side 161 of the tap lock 108. The first, second, and front walls 193, 194, 195 may be attached (integrally attached) to each other at the transitions between the first lateral side 165 and the front side 161 and between the second lateral side 167 and the front side 161. The first, second, and front walls 193, 194, 195 may be fixed (e.g., integrally attached) to the first and second engagement walls 172, 174 and may extend along the first axis 114 therefrom. Also, the first and second walls 193, 194, 195 may taper gradually closer to the axis 114 and gradually closer together as they extend further away from the second engagement wall 174. Additionally, the window opening 175 may be included through the front wall 195.

Moreover, the barrier member 168 may include a barrier wall 196. The barrier wall 196 may extend substantially normal to the first axis 114. The barrier wall 196 may substantially define the bottom end 173 of the tap lock 108. The barrier wall 196 may be attached (e.g., integrally connected) to the first and second walls 193, 194 and to the front wall 195, leaving the back side 163 open to receive the spout 148.

Furthermore, the barrier member 168 may include an interior surface 199 that opposes the head 160 of the valve member 156 when the tap lock 108 is attached. The interior surface 199 may include a projection 197. The projection 197 may be dome-shaped in some embodiments. As shown in FIG. 3, the projection 197 may have a contoured surface that is contoured according to the curvature of the head 160.

In some embodiments, the tap lock 108 may further include a rib 198 that is attached to the barrier member 168 and the front wall 195. The rib 198 may be rectangular and block-shaped. The rib 198 may increase stiffness at the joint between the barrier wall 196 and the front wall 195 of the retainer member 170. Also, the rib 198 may be configured for abutment with the tap dispensing closure 106 as will be discussed in greater detail below.

As mentioned, the tap lock 108 may be manufactured via a molding process, such as an injection molding process. The tap lock 108 may also be constructed using an additive manufacturing method or other rapid manufacturing technique. The tap lock 108 may be unitary and may include a relatively small amount of material. Additionally, the tap lock 108 may be dimensionally scaled up or down easily depending on the relative size of the tap dispensing closure 106. For these reasons, the tap lock 108 provides a wide variety of manufacturing advantages.

Once formed, the tap lock 108 may be attached to the tap dispensing closure 106. In some embodiments, the tap dispensing closure 106 is attached (e.g., threadably attached to the container body 101) before the tap lock 108 is attached to the tap dispensing closure 106. In other embodiments, the tap dispensing closure 106 is attached to the container body 101 after the tap lock 108 is attached.

To attach the tap lock 108, the tap lock 108 may be oriented with the back side 163 facing toward the tap dispensing closure 106 along the second axis 116 (FIG. 1). The tap lock 108 may be advanced along the second axis 116 toward the tap dispensing closure 106. The pocket 184 of the engagement member 166 may receive the flange 150 of the support structure 132. The flange 150 may advance into the pocket 184 along the second axis 116 as the tap lock 108 is advanced closer to the support structure 132 with the first engagement wall 172 opposing the top side 151 of the flange 150 and the second engagement wall 174 opposing the underside 152 of the flange 150. Additionally, the cutout aperture 186 may receive the support structure 132. Specifically, the first aperture in the first engagement wall 172 may receive the actuator base 154 and the second aperture in the second engagement wall 174 may receive the spout 148. As the tap lock 108 is advanced along the second axis 116, the snap-fit retainers 192 may resiliently deflect away from the first axis 114 to allow passage of the actuator base 154 and the spout 148 into the cutout aperture 186. Further advancement of the tap lock 108 may allow the snap-fit retainers 192 to resiliently recover back to a neutral position shown in the Figures.

Moreover, as the tap lock 108 is attached, the interior surface 199 of the barrier wall 196 may be disposed proximate the spout opening 133 and the head 160 of the valve member 156. As the tap lock 108 is advanced along the second axis 116, the projection 197 and/or the valve member 156 may resiliently flex along the first axis 114 to allow passage of the projection 197 into the head 160 of the valve member 156 (FIG. 3).

Once the tap lock 108 is fully pushed onto the tap dispensing closure 106, the tap lock 108 and/or the support structure 132 may resiliently recover. The tap lock 108 may come to rest with the engagement member 166 of the tap lock 108 securely fastened to the support structure 132. At least part of the first rim 188 (including the retainers 192) may nest against and/or releasably grasp (grip) the actuator base 154. Likewise, at least part of the second rim 190 (including the retainers 192) may nest against and/or releasably grasp (grip) the spout 148. Accordingly, in some embodiments, the first engagement wall 172 and/or the second engagement wall 174 may grip the support structure 132 to engage and retain the tap lock 108 thereon. Also, there may be relatively little clearance between the first and second engagement walls 172, 174 and the flange 150. In some embodiments, there may be abutting contact between the flange 150 and at least one of the first and second engagement walls 172, 174. Furthermore, there may a frictional and/or interference fit between the engagement member 166 of the tap lock 108 and the flange 150 to further secure the tap lock 108 attached to the tap dispensing closure 106.

Additionally, as shown in FIG. 3, the barrier wall 196 may cover over the spout opening 133 and the head 160 of the valve member 156. The projection 197 may be received within the concavity of the head 160. Also, the interior surface 199 may abut and secure against the spout 148 at the spout opening 133. Furthermore, as shown in FIG. 3, the rib 198 may abut against the spout 148. Thus, registration of the tap lock 108 onto the tap dispensing closure 106 may be ensured and the tap lock 108 may be securely retained thereon. The retainer member 170 may also maintain the barrier wall 196 in this position, limiting travel of the valve member 156 along the first axis 114, away from the closed (sealed) position and toward the opened (unsealed) position to prevent leakage of the material from the outlet passage 134. The window opening 175 exposes the spout 148 as well as the attached areas of the tap lock 108 and the tap dispensing closure 106; therefore, a user may visually check that the tap lock 108 is properly attached and remains in this position. It will be appreciated, however, that the window opening 175 is an optional feature and may be omitted in some embodiments of the present disclosure.

Once the tap lock 108 is attached, the tap dispensing closure 106 may be attached to the container body 101 if not already done. Then, the cup 110 (FIG. 1) may be attached to the seat 112 of the container body 101. Again, it is noted that the tap lock 108 may fit entirely inside the cup 110 in the space between the cup 110 and the tap dispensing closure 106. Thus, the compact design of the tap lock 108 increases its usefulness and manufacturing efficiency.

It will be appreciated that the tap lock 108 may be easily and intuitively attached to the tap dispensing closure 106. Also, when necessary, the tap lock 108 may be easily and intuitively removed. The user can remove the cup 110 and then manually pull the tap lock 108 away from the tap dispensing closure 106. The tap lock 108 may resiliently flex to allow removal, and the tap lock 108 may be discarded. Then, when the actuator 164 is pushed, the valve member 156 is allowed to travel from the closed position to the open position to dispense the material from the outlet passage 134.

Figure 5:
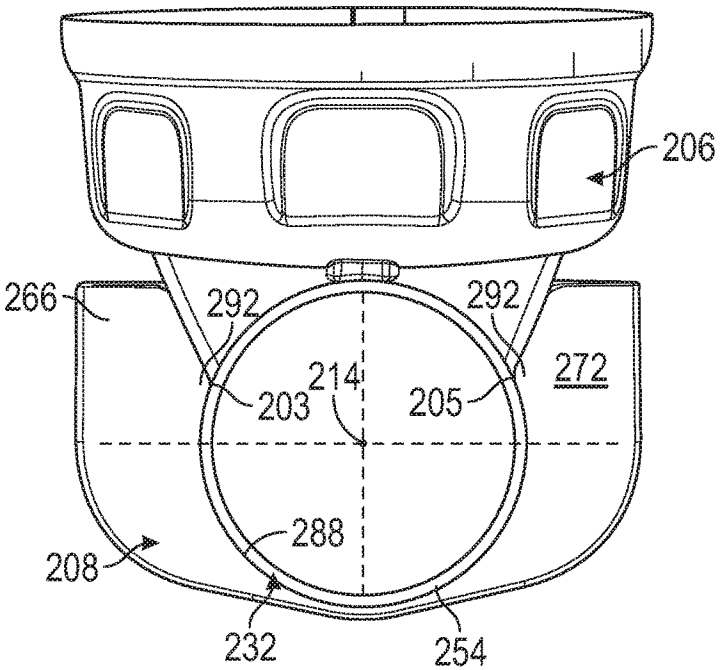
FIG. 5 is a top view of the container closure device according to additional example embodiments of the present disclosure.

Referring now to FIG. 5, another embodiment of the tap lock 208 is illustrated according to additional embodiments of the present disclosure. The tap lock 208 may be substantially similar to the embodiments discussed above with respect to FIGS. 1-4 except as noted. Components that correspond to those of FIGS. 1-4 are indicated in FIG. 5 with corresponding reference numbers increased by 100.

The engagement member 266 of the tap lock 208 may include the snap-fit retainers 292. As shown, the first engagement wall 272 may include the first rim 288, and the first rim 288 may extend about the first axis 214 from a first terminal end 203 to a second terminal end 205. The first rim 288 may be C-shaped and may be substantially continuous and smooth between the first terminal end 203 and the second terminal end 205. The snap-fit retainers 292 may be defined at the terminal ends 203, 205. The snap-fit retainers 292 may project inward, and the rim 288 may extend circumferentially about the actuator base 254 of the tap dispensing closure 206 more than one hundred eighty degrees (1800). Accordingly, the engagement member 266 may grip onto the support structure 232 of the tap dispensing closure 206.

Accordingly, the tap lock 108, 208 of the present disclosure provides a useful and effective tool for preventing leakage from the container assembly 100. The tap lock 108, 208 is designed to be intuitive and ergonomic for use. The tap lock 108, 208 may be manufactured efficiently as well.

While the foregoing description focuses primarily on articles of manufacture, namely, tap locks and tap dispenser lock devices for containers, there has also been disclosed methods for manufacturing the same. Such methods for manufacturing the disclosed tap locks, tap dispenser lock devices, and/or container assemblies may entail direct fabrication of any component included therein. Further, any number of entities can fabricate these components of the container assembly, which can be produced utilizing various manufacturing techniques including, but not limited to, injection molding, blow molding, and additive manufacturing processes. Furthermore, a method for manufacturing a tap dispenser lock device may include the step or process of installing and attaching the tap lock to the tap dispensing closure. In further instances, the above-described method for manufacturing a tap dispenser lock device may include the step or process of providing the tap dispensing closure (whether by purchase from a supplier, by independent fabrication, or by otherwise obtaining the closure). Additionally, in at least some implementations, the method may include providing the tap lock (whether by purchase, by independent fabrication, or by otherwise obtaining the tap lock).

Terms such as "first" and "second" have been utilized above to describe similar features or characteristics (e.g., rotational directions) in view of the order of introduction during the course of description. In other sections of this Application, such terms can be varied, as appropriate, to reflect a different order of introduction. While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It is understood that various changes may be made in the function and arrangement of elements described in an exemplary embodiment without departing from the scope of the invention as set forth in the appended claims.

What is claimed is:

1. A tap dispenser lock device comprising:

a tap dispensing closure configured for selective dispensing of a material from a container body, the tap dispensing closure including a support structure with an outlet passage configured to dispense the material, the tap dispensing closure including a valve member that is supported for movement along an axis relative to the support structure between an open position and a closed position, the outlet passage being open for dispensing of the material when the valve member is in the open position, the outlet passage being closed by the valve member when the valve member is in the closed position, the tap dispensing closure including an actuator for selectively actuating the valve member from the closed position to the open position; and a tap lock including an engagement member, a barrier member, and a retainer member that extends between the engagement member and the barrier member and that retains the engagement member at a fixed position relative to the barrier member, the engagement member removably attached to the support structure with the barrier member disposed proximate the outlet passage and the valve member, the barrier member limiting movement of the valve member in a direction along the axis away from the closed position toward the open position to prevent leakage of the material from the outlet passage.

2. The tap dispenser lock device of claim 1, wherein the support structure of the tap dispensing closure includes a flange; and wherein the engagement member defines a pocket that receives the flange of the support structure to removably attach to the support structure.

3. The tap dispenser lock device of claim 2, wherein the flange extends laterally from the axis and from a first side of the actuator, wherein the flange extends laterally from the axis and from a second side of the actuator, the flange including a top side and an underside, the actuator projecting from the top side of the flange, the underside facing opposite the top side;

wherein the engagement member includes a first engagement wall and a second engagement wall that are spaced apart to cooperatively define the pocket, the first engagement wall opposing the top side of the flange, and the second engagement wall opposing the underside of the flange.

4. The tap dispenser lock device of claim 2, wherein the engagement member includes a plurality of engagement walls that collectively define the pocket;

wherein the barrier member includes a barrier wall that extends across and covers over the outlet passage; and wherein the retainer member includes at least one retainer wall that extends between at least one of the plurality of engagement walls and the barrier wall.

5. The tap dispenser lock device of claim 4, wherein the barrier wall includes a projection that projects into the valve member.

6. The tap dispenser lock device of claim 4, wherein the support structure includes a spout with the outlet passage extending therethrough;

wherein the tap lock receives and covers over a first portion of the spout; and wherein the at least one retainer wall includes a window opening that reveals a second portion of the spout.

7. The tap dispenser lock device of claim 1, wherein the engagement member includes a first engagement wall and a second engagement wall that are spaced apart to cooperatively define a pocket that receives the support structure;

wherein at least one of the first engagement wall and the second engagement wall includes an aperture that receives the support structure.

8. The tap dispenser lock device of claim 7, wherein the aperture is defined by an inner rim that extends about and receives the support structure; and wherein the inner rim releasably grasps the support structure to engage the tap dispensing closure.

9. The tap dispenser lock device of claim 8, wherein the inner rim includes a snap-fit retainer that snap fits to the support structure.

10. The tap dispenser lock device of claim 9, wherein the snap-fit retainer includes a projection of the inner rim.

11. The tap dispenser lock device of claim 9, wherein the inner rim extends about the axis from a first terminal end and a second terminal end; and wherein the inner rim is substantially continuous and smooth between the first terminal end and the second terminal end.

12. The tap dispenser lock device of claim 1, wherein the support structure includes a spout; and wherein the tap lock includes a rib that is attached to the barrier member and the retainer member;

wherein the rib abuts against the spout.

13. The tap dispenser lock device of claim 1, wherein the engagement member, the barrier member, and the retainer member are integrally attached such that the tap lock is unitary.

14. The tap dispenser lock device of claim 1, wherein the support structure includes a coupling for removably attaching to the container body.

15. A container assembly comprising:

a container body configured to contain a liquid material;

a tap dispensing closure attached to the container body and configured for selective dispensing of the material therefrom, the tap dispensing closure including a support structure with an outlet passage configured to dispense the material, the tap dispensing closure including a valve member that is supported for movement along an axis relative to the support structure between an open position and a closed position, the outlet passage being open for dispensing of the material when the valve member is in the open position, the outlet passage being closed by the valve member when the valve member is in the closed position, the tap dispensing closure including an actuator for selectively actuating the valve member from the closed position to the open position; and a tap lock including an engagement member, a barrier member, and a retainer member that extends between the engagement member and the barrier member and that retains the engagement member at a fixed position relative to the barrier member, the engagement member removably attached to the support structure with the barrier member disposed proximate the outlet passage and the valve member, the barrier member limiting movement of the valve member in a direction along the axis away from the closed position toward the open position to prevent leakage of the material from the outlet passage.

16. The container assembly of claim 15, wherein the container body includes a seat; and further comprising a cup that is removably attached to the seat; and wherein the tap dispensing closure and the tap lock fit within the cup when the cup is removably attached to the seat of the container body.

17. The container assembly of claim 15, wherein the support structure of the tap dispensing closure includes a flange; and wherein the engagement member defines a pocket that receives the flange of the support structure to removably attach to the support structure.

18. The container assembly of claim 15, wherein the tap dispensing closure is removably attached to the container body.

19. The container assembly of claim 15, wherein the engagement member includes a first engagement wall and a second engagement wall that are spaced apart to cooperatively define a pocket that receives the support structure;

wherein at least one of the first engagement wall and the second engagement wall includes an aperture that receives the support structure;

wherein the aperture is defined by an inner rim that extends about and receives the support structure; and wherein the inner rim includes a snap-fit retainer that snap fits to the support structure.

20. A method of manufacturing a tap dispenser lock device comprising:

providing a tap dispensing closure configured for selective dispensing of a material from a container body, the tap dispensing closure including a support structure with an outlet passage configured to dispense the material, the tap dispensing closure including a valve member that is supported for movement along an axis relative to the support structure between an open position and a closed position, the outlet passage being open for dispensing of the material when the valve member is in the open position, the outlet passage being closed by the valve member when the valve member is in the closed position, the tap dispensing closure including an actuator for selectively actuating the valve member from the closed position to the open position;

providing a tap lock that includes an engagement member, a barrier member, and a retainer member that extends between the engagement member and the barrier member and that retains the engagement member at a fixed position relative to the barrier member; and removably attaching the engagement member to the support structure with the barrier member disposed proximate the outlet passage and the valve member, the barrier member limiting movement of the valve member in a direction along the axis away from the closed position toward the open position to prevent leakage of the material from the outlet passage.

* * * * *